United States Patent [19]

Finkel et al.

[11] Patent Number: 4,884,420

[45] Date of Patent: Dec. 5, 1989

[54] CAGE WITH FLOATING NUT ASSEMBLY

[75] Inventors: A. Milton Finkel, No. Hollywood; Stephan F. Bunka, Tarzana, both of Calif.

[73] Assignee: Dennis E. McGoldrick, Trustee, Gardena, Calif.

[21] Appl. No.: 832,178

[22] Filed: Feb. 24, 1986

[51] Int. Cl.[4] ..... E05B 73/00

[52] U.S. Cl. ..... 70/58; 70/62; 211/4; 248/551; 248/553; 248/917

[58] Field of Search ..... 70/57, 58, 62, 63; 411/109, 112, 113, 352, 353, 337, 517–519, 116, 119; 211/4, 28; 248/500–503, 551–553, 1 A, 1 B, 1 H, 51, 52; 400/713, 714; 312/265; 108/110, 107, 92, 59

[56] References Cited

U.S. PATENT DOCUMENTS

| | | | |
|---|---|---|---|
| 1,798,526 | 3/1931 | Fitzgerald | 411/352 |
| 2,147,899 | 2/1939 | Hoern | 411/116 X |
| 2,635,939 | 4/1953 | Obenchain | 248/552 X |
| 2,804,180 | 8/1957 | Richardson | 411/119 X |
| 2,943,138 | 6/1960 | Reager | 248/51 X |
| 3,010,052 | 11/1961 | Heath et al. | 312/265 X |
| 3,106,901 | 10/1963 | Locek | 108/59 X |
| 3,180,473 | 4/1965 | Garvey | 70/57 X |
| 3,570,418 | 3/1971 | Gooding | 312/265 X |
| 3,766,759 | 10/1973 | Artner | 70/58 |
| 3,771,338 | 11/1973 | Raskin | 70/58 |
| 3,859,826 | 1/1975 | Singer et al. | 70/58 |
| 3,879,096 | 4/1975 | Blodee | 312/265 |
| 3,918,599 | 11/1975 | Porter | 248/552 X |
| 4,193,435 | 3/1980 | Charles et al. | 411/113 |
| 4,252,007 | 2/1981 | Kerley | 70/58 |
| 4,268,099 | 5/1981 | Clausen | 248/551 X |
| 4,294,496 | 10/1981 | Murez | 248/1 A |
| 4,304,408 | 12/1981 | Greenawalt | 411/353 X |
| 4,579,311 | 4/1986 | Spranza, III | 70/58 X |
| 4,613,109 | 9/1986 | Boscacci | 248/553 |
| 4,624,510 | 11/1986 | Jedziniak | 248/1 X |
| 4,634,009 | 1/1987 | Gassaway | 70/57 X |
| 4,635,893 | 1/1987 | Nelson | 248/1 X |
| 4,640,485 | 2/1987 | Day et al. | 248/1 X |
| 4,655,429 | 4/1987 | Gaenzle et al. | 70/58 X |
| 4,656,848 | 4/1987 | Rose | 70/58 |

*Primary Examiner*—Gary L. Smith
*Assistant Examiner*—Suzanne L. Dino
*Attorney, Agent, or Firm*—Frank L. Zugelter

[57] ABSTRACT

A cage for protecting computer equipment and the like, comprising a multiple number of spaced platforms among which such equipment can be mounted and secured therein without being capable of unauthorized removal. The platforms are secured together by pairs of rods having case hardened sleeves freely rotated thereabout, a lock mechanism being applied to the top of each of such rods, the unlocking of which provides an assembly and disassembly procedure for the cage. Upturn lips on the front and rear edges of the lowermost platform, together with pairs of such rods and sleeves in the four corners of the cage, prevent removal in a sliding manner of any equipment mounted in the space between the platforms. A rigid metal guard for the cable connected to the rear of the mounted equipment is provided, along an up-turned lip edge of a platform, while a unique floating nut assembly mounted at the bottom of each of the connecting rods and sleeves provides ease of insertion and removal (assembly) of the rod, sleeve and lock mechanism to the cage. A stacking arrangement of platforms is also provided in the invention, as well as a keyboard ledge attached to the lowermost platform, such ledge non-removable after cage assembly.

24 Claims, 3 Drawing Sheets

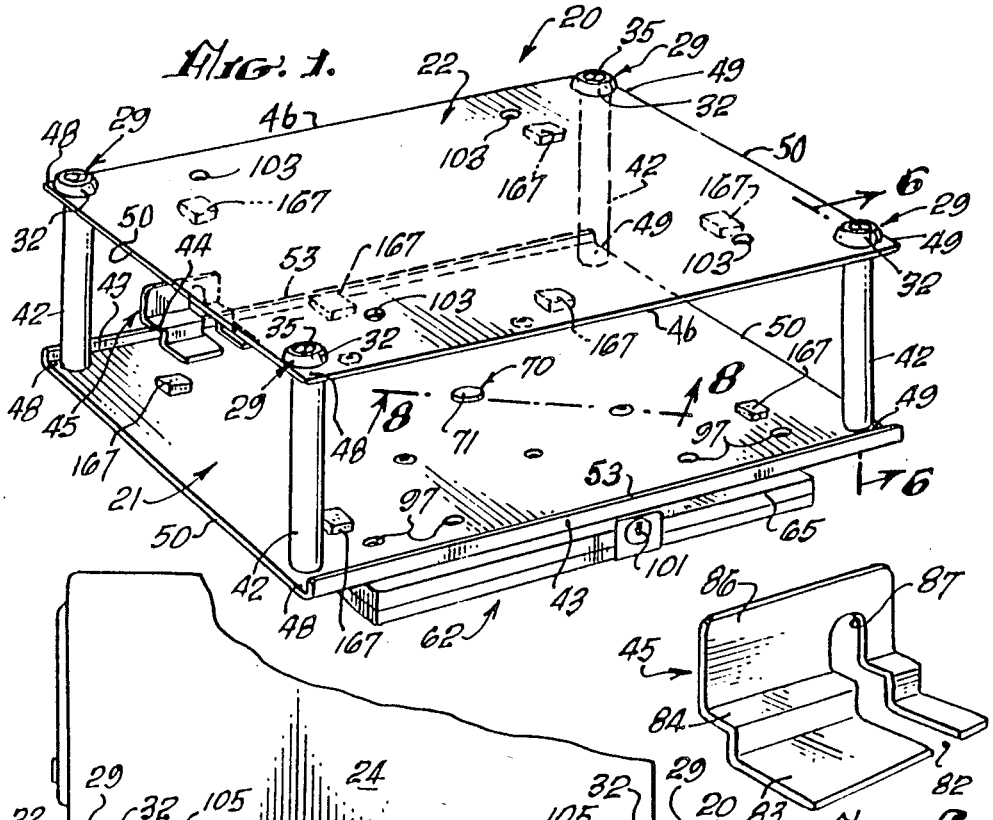
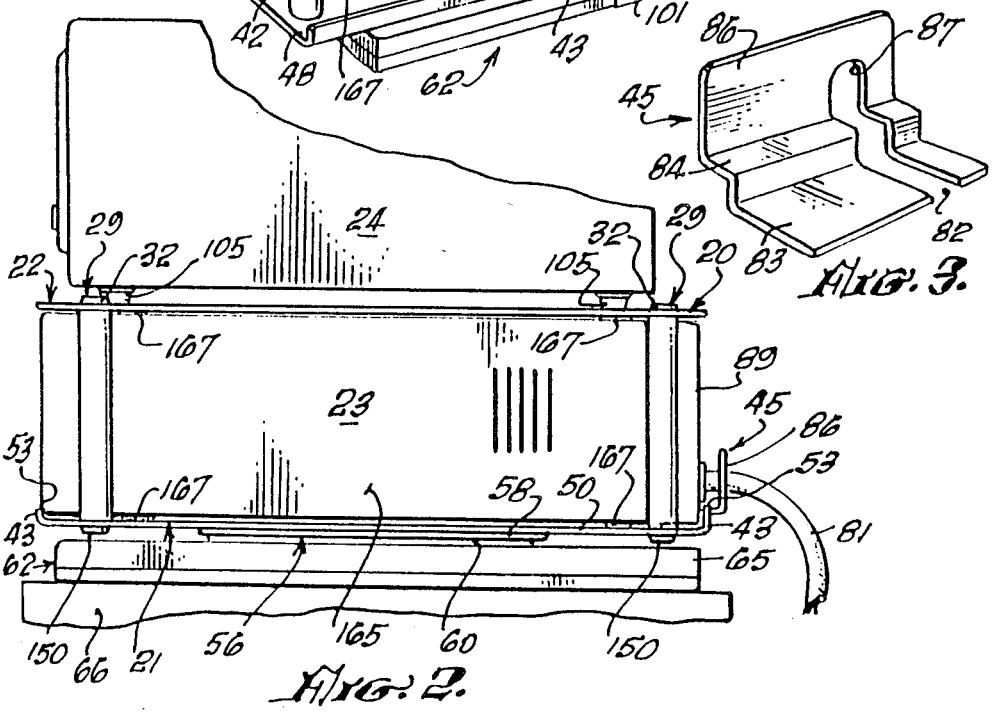
FIG. 2.

CAGE WITH FLOATING NUT ASSEMBLY

TECHNICAL FIELD

This invention is directed to cage assemblies for housings of all kinds, and is particularly related to the protection of equipment in their housing and retained thereby, from theft or unauthorized removal.

BACKGROUND ART

Various locking and security devices for equipment, office machines and other articles are disclosed in the following U.S. Pat. No. 3,220,556; 3,744,282; 4,252,007; and 4,268,099.

DISCLOSURE OF INVENTION

Office equipment today includes typewriters, computers, monitors, and the like, most of which are contained within housings. These machines facilitate work performed in the office. At times, these machines are cannibalized for their parts, or removed unauthorizedly, stolen, or otherwise taken, requiring either replacing the machine or cannibalizing another machine for parts. All of this causes work stoppages, delays in producing work product development by the utility of these machines, further costs in replacement, and the like.

One approach to prevent these occurrences is to secure equipment, articles, or the like to a support surface, such as a desk top. Chains, cables, locks are frequently used to do this. Security accessory devices also are employed, securing machine to support surface. Bolt cutters, saws, and the like are used in efforts to releases such equipment from their locked moorings, and in many instances, are successful without damaging the equipment.

The approach in this invention is to provide a zone of protection for the housing of the equipment or machines. This zone is surrounded by cage assemblies comprising various elements, and by which the machines cannot be released from their zones without damaging them along with the damaged cage assembly or assemblies, all for naught. And yet, the invention provides for ease of installation and removal of the captured machines with but the turn of a key and by simple hand manipulation of the cage's elements to assemble and disassemble it. Assembly and disassembly of the cages are easy and swift, and complete in capturing and removing their corresponding housings.

A salient advantage of this invention is the knowledge that unauthorized removal of an office equipment housing captured by a cage assembly of this invention requires damaging of or destruction of such housing and the machine it houses as well as damaging or destroying its cage assembly.

BRIEF DESCRIPTION OF THE INVENTION

The invention is directed to a cage assembly comprising a pair of spaced platform members secured together by connecting rods, the connecting rods having freely-rotatable case-hardened sleeves roundabout themselves to prevent cutting of the rods, a lock mechanism applied to each of the connecting rods, the unlocking of the lock mechanism disassembling the connecting rod from the platforms. The lower platform includes upturned lips on its front and rear edges to prevent a forward or rearward movement of a housing contained within the cage assembly. The depth (not height) of the housing is greater than the distance between the pairs of sleeves mounted proximate to corners along each side of the cage assembly. Thus, the locations of the sleeves prevent sideways movement of such a housing from within the platforms. The space between platforms accomodates the height of the housing which is greater than the distance between the noted lips and the next higher platform. A cable guard is included, mounted in a recess on one of the lips to prevent damage to the connection of cable to housing. Means are provided to secure the cage assembly to either a security equipment device or directly to a support surface. A lazy-Susan appliance attached to the bottom of the cage assembly provides for a rotational feature for the entire cage assembly and its housing.

A unique feature is a floating-nut assembly mounted at the bottom of each of the connecting rods and which provides ease of insertion and removal of the mechanism's key.

A housing can be securely mounted atop the cage assembly, likewise not being removeable without damaging it with the cage assembly in the process. And a keyboard retainer in included in the invention when the machine housed in the cage assembly, such as a central processing unit (CPU) of a computer, requires a terminal keyboard for operation of the computer.

Also, the platforms can be tiered into a number greater than two should a stacking arrangement of articles be desired.

An object of this invention is to provide a unique cage assembly which provides a zone of protection for a housing contained in it, or on it.

A further object of this invention is to provide a floating-nut assembly which provides ease of assembly and disassembly of the invention while securing it together.

A further object of this invention is to provide a rotational feature for the cage assembly by which it can be turned for the convenience of the user of the articles captured by such cage assembly.

These and other objects and advantages will become more apparent by a complete and full reading of the following specification, the appended claims thereto, and the drawing comprising three (3) sheets of 12 FIGURES.

BRIEF DESCRIPTION OF THE DRAWING

FIG. 1 is a perspective view of a cage assembly embodying the invention, and its application to a security accessory.

FIG. 2 is a side-elevational view of the cage of FIG. 1, modified by the additional of a supporting surface under the security accessory and an article secured atop the cage.

FIG. 3 is a perspective of a cable guard utilized in the embodiment shown in FIG. 1.

BEST MODE OF CARRYING OUT THE INVENTION

Figures 4, 5, 6, 7:
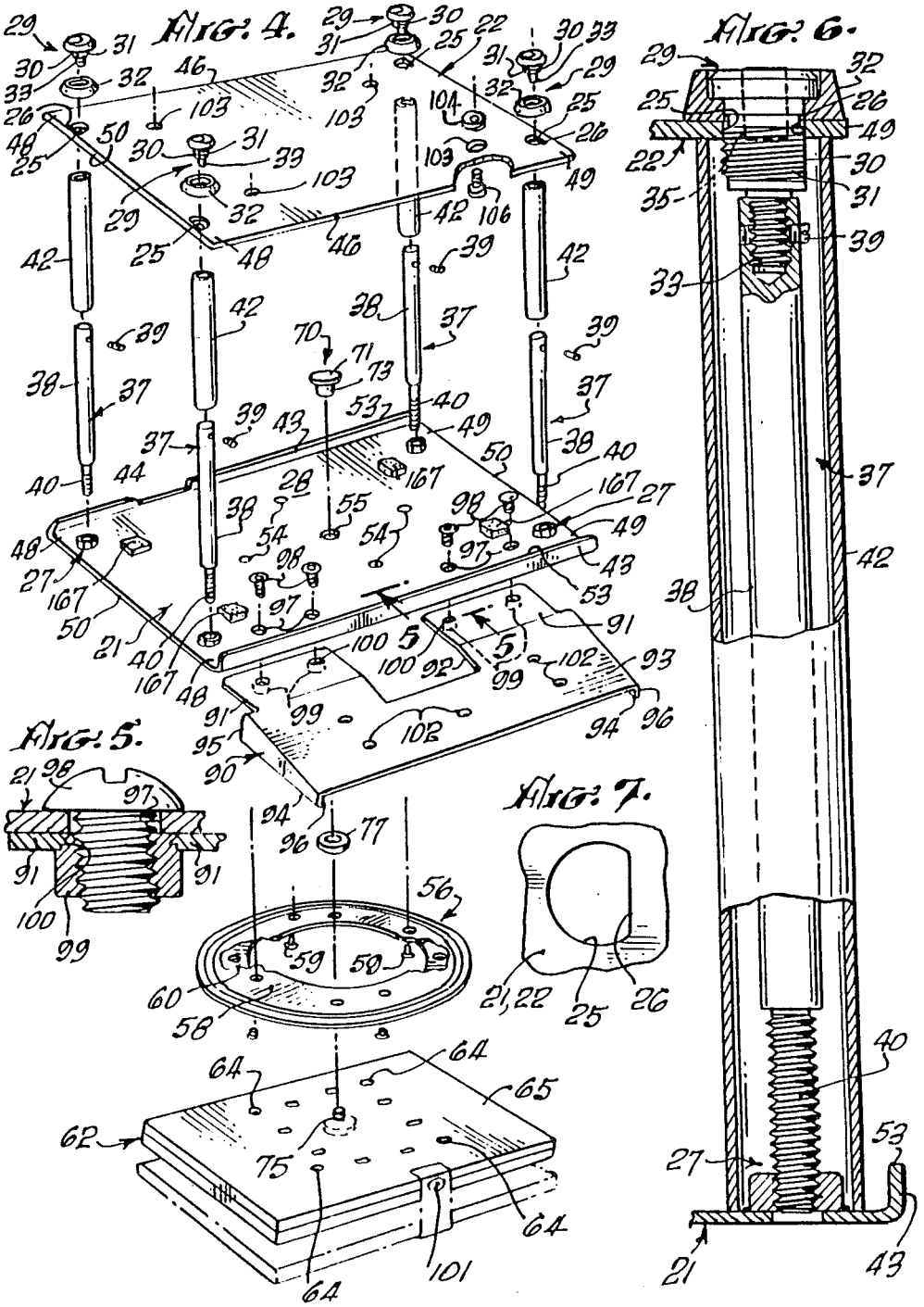
FIG. 4 is an exploded perspective view of the embodiment shown in FIG. 1, modified by the inclusion of a keyboard retainer.
FIG. 5 is a view taken on line 5—5 of FIG. 4.
FIG. 6 is a view taken on line 6—6 of FIG. 1.
FIG. 7 is a fragmentary view of the upper platform member shown in FIG. 4.

Referring now to the drawing wherein reference characters correspond to like numerals hereinafter, FIG. 1 generally illustrates a deck assembly or security cage 20 embodying the invention. Cage 20 comprises a pair of spaced, generally parallel and aligned, shelf-like or platform members 21, 22, their geometrical configuration generally being determined by articles 23, 24 which are to be housed in or otherwise retained to or by cage 20 in its operation. Each such member 21, 22 includes a formation 25 forming a hole, FIG. 4, approximately adjacent each of its corners, the corresponding hole formations 25 in lower shelf 21 (FIG. 12) being in alignment with its corresponding hole formation 25 in the other or top platform 22.

Each hole formation 25 in platform 22 includes at least one flat side 26, FIG. 7, while in one embodiment, FIG. 6, fastening means 27, such as a threaded nut, is secured, such as by welding, to each formation 25 on the inside or top surface 28, FIG. 4, of shelf 21. A lock mechanism 29 having at least one wall 30, FIG. 4, in its body flat to engage a corresponding flat side 26 in platform 22 is mounted to each hole formation 25, or can be seated in an annular collar 32 atop of each hole formation 25 in platform 22. It may be noted that one flat side 26 is illustrated in hole formation 25, FIG. 7; it is to be understood that either one flat side 26 or two opposing flat sides 26 of hole formation 25 may be utilized in platform 22, depending upon either the make or model of the particular lock mechanism 29 incorporated into a given cage assembly 20, and which includes either one flat side or two flat sides to its body 31. Lock mechanism 29 includes a threaded shaft 33 which extends below body 31 and which is part of the lock mechanism's cylinder 35 shown in phantom in FIG. 6.

Each lock mechanism 29 is part of a means 37, FIG. 6, to secure shelf-like members 21, 22 together. Each securing means 37 comprises lock mechanism 29, a connecting rod 38 threaded to and fixed to shaft 33 by a set pin 39, and a threaded stem 40 on rod 38 for threaded attachment to fastening means 27. As a key (not shown) is inserted in the usual manner into the keyhole of the lock's cylinder 35, and the cylinder rotated, its shaft 33 and body 31 also rotate, however, when lock mechanism 29 is installed in a hole formation 25 with a flat side 26, body 31 does not rotate. A case-hardened sleeve 42 of a length not quite equal to the spacing between members 21, 22, is mounted about each connecting rod 38 and is freely rotatable thereabouts and within the space between members 21, 22, its purpose being to prevent severing such as by sawing across its periphery, of shaft or stem.

Shelf 21 includes lips 43, FIGS. 1, 4, formed on its transversely-extending edges, its transversely-extending rear edge also including a recess 44, FIG. 4, in its lip 43 for seating a cable guard 45, FIGS. 1, 3, in assembly of and operation of cage 20. Lips 43 need not be included along transversely-extending edges 46 in upper shelf or platform 22 when the latter constitutes a terminal top for a cage 20 which includes in a particular assembly two or more platform members.

It is to be noted, FIG. 4, that each pair 48, 49 of corners in the platforms is formed by a side edge 50 and a transversely-extending edge having a lip or lipped edge 43, except that lip 43 may be omitted in a topmost platform. A caged article or housing 23, FIG. 2, is of a (depth) dimension greater than the distance between each pair of securing means 37 disposed in the corresponding pairs or corners 48, 49 along their corresponding joined edges, so that housing 23 cannot be slid transversely out of cage 20. And opposing frontal and rear lips 43 deny the sliding of housing 23 frontwardly or rearwardly out of cage 20 by reason of the height of housing 23 being greater than the distance between the undersurface of the platform member and a top edge 53, FIG. 2, for lips 43 in a platform adjacently disposed below such undersurface.

Figure 8:
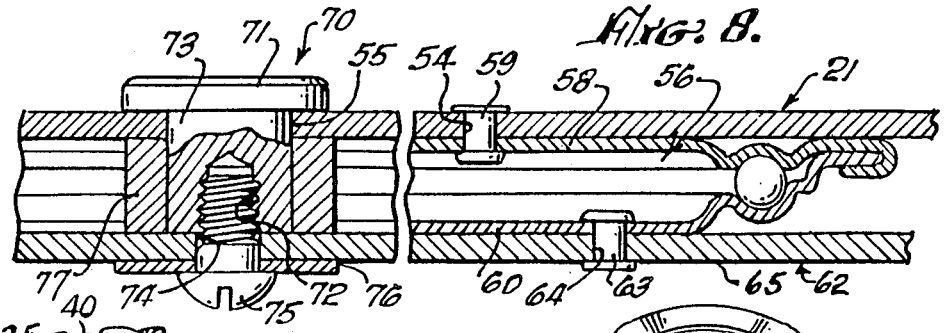
FIG. 8 is a view taken on line 8—8 of FIG. 1.

Lower shelf 21 includes a set of hole formations 4 provided at radially-extending distances from a centrally-located hole formation 55 and by which a conventional lazy-Susan assembly 56, FIGS. 2, 4, 8, is secured below and to shelf 21. Without detailing a conventional lazy-Susan assembly 56, although FIGS. 4 and 8 provide clear illustration for such an assembly 56, it will be seen, for purpose of disclosure here, that an upper disk 58 of assembly 56 is secured to the underside of shelf 21 by rivets 59 installed in holes 54 and a lower disk 60 of assembly 56 is secured to the upperside of another article 62, such as a security accessory, by means of another set of rivets 63, FIGS. 4, 8, installed in corresponding holes 64 formed in lower disk 60 and a top mounting member 65, FIGS. 4, 8, of security accessory 62. Security accessory 62 itself is securely mounted to a support surface 66, FIG. 2 such as a desk top. The net effect of assembly 56 is to provide a rotational feature for cage 20 that would not be included were shelf 21 secured directly to security accessory 62 or a support surface 66.

Accessory 62 itself prevents theft or unauthorized removal of cage 20 itself and any article 23, 24, FIG. 2, contained within or upon it. Any example of security accessory 62 is disclosed in our co-pending patent application, Ser. No. 06/609,828, filed May 14, 1984, now U.S. Pat. No. 4,739,637 granted Apr. 26, 1988, entitled: Locking Device For Portable Equipment, and (by reference) in prior art teachings cited in such patent.

A fail-safe means 70, FIGS. 1, 4, 8, is provided to secure cage 20 directly to a security device 62 or if desired, to another support surface. A capped pin 71, including a threaded bore 72 in its body 73, is mounted about and in hole formation 55 of shelf 21, the body 73 extending toward security device 62 or other mounting surface. An aperture 74 in the top plate 65 of security device 62 is provided. A fastener 75 and its spring washer 76 are inserted from the underside of top plate 65 into bore 72, fastener 75 being threadedly attached to pin 71, thereby securing lower shelf member 21 to article 62. Spring washer 76 acting against fastener 75 provides adjustability of the amount of friction desired during rotation or swiveling of the cage assembly in operation. A spacer 77, FIG. 4, 8, is mounted about body 73 and between shelf 21 and member 65.

It should now be apparent that neither a lazy-Susan 56 or a security accessory 62 is necessary in the operation of cage 20, should it be desired to secure lower shelf 21 directly to a desk top or the like, with the use of hole formation 55 in shelf 21 and securing means 70.

Cable retaining guard 45, FIG. 3, is provided to prevent damage to the connection of a cable 81, FIG. 2, projecting from article 23 housed in cage 20. Guard 45 includes a slot 82 projecting from its lower-most flange 83 adapted to seat, in assembly, on the upper surface of lower shelf 21, the slot extending into and passing though an intermediate 1-shaped portion the leg 84 of which, in assembly, seats in recess 44, FIG. 4, of lip 43, to a vertically upwardly extending flange 86 which includes the closed end 87 of slot 82 in the guard 45. Flange 83 is sufficiently long that upon sliding the guard along lip 43 towards a sleeve 42, it cannot slide by such sleeve. The depth of recess 44 provides the wherewithal for leg 84 of guard 45 to be flush surface completely along the length of lip 43, while the portion of slot 82 in flange 86 embraces cable 81, FIG. 2, inserted into such slot via its opening in flange 83, and which cable 81 extends from housing 23, say, for a computer, that is captured in cage 20 to an electrical outlet. A rear wall 89 of housing 23 hovers over or seats on flange 83 of guard 80 to prevent its removal.

A keyboard retainer 90, FIG. 4, is provided for operative connection to cage 20, and comprises mounting surfaces 91 in the form of a pair of feet separated by a space 92 and an inclined ledge 93 extending from such feet 91 and supported by a pair of legs 94 at its opposing ends. Legs 94 include a deeper dimension at their one terminus 95 than at their other terminus 96 so as to provide a desired inclination for ledge 93 and on which a keyboard (not shown) or the like can be suitably secured. A series of apertures 97 is provided in shelf 21, through which fasteners 98, FIGS. 4, 5, project into corresponding fastening elements 99 secured about holes 100 in and along the underside of feet 91. Feet 91 slip in between lower shelf 21 and security accessory 62, or other mounting surface, to be securely mounted to shelf 21 by fasteners 98 and clinching nuts 99, FIG. 5 (shown in phantom in FIG. 4). Clinching nuts 99 suitable for this invention are made and sold by Penn Engineering & Manufacturing Corp., Danboro PA 18196. The space 92 provides access to a lock 101, FIG. 1, included in security accessory 62, in order to release cage 20 from its secured position upon such accessory 62, the member 65, FIGS. 4, 8, of accessory 62 staying with cage 20 in such a release, along with keyboard retainer 90. Hole formations 102 are provided in inclined ledge 93 for securing the keyboard (not shown) thereto in a conventional manner.

The invention also provides for capture to cage assembly 20 of an article or housing 24, FIG. 2, outside of securing means 37, and by which article 24 cannot be unauthorizedly removed or stolen. Article 24, as for example a computer viewer screen (monitor) accompanying a computer in housing 23, is secured to the upper surface to the top platform 22 in assembly 20 by suitable conventional fastening means (not shown) inserted through a series of hole formations 103, FIG. 4, formed in platform member 22, the positions or locations of such formations 103 corresponding to cooperating threaded holes or the like (not shown) conventionally mounted in the underside of article 24, the extension of such holes or the like being projected through the article's (rubber) feet 105, FIG. 2. In a singular illustration shown in FIG. 4, a case-hardened sleeve, similar to and functioning like sleeve 42, is or can be mounted about or in substitution for feet 105, FIG. 2, and around each fastener 106 that secures article 24 to platform 22 via each hole formation 103. It should be apparent that once such fastening means secure article 24 to platform 22, with platform 22 and article 24 as part and parcel of an assembled cage assembly 20, that article 24 is captured along with housing 23, as there is no way to gain access to release the fastening means which were inserted through hole formations 103 from the underside of platform 22.

Figure 9:
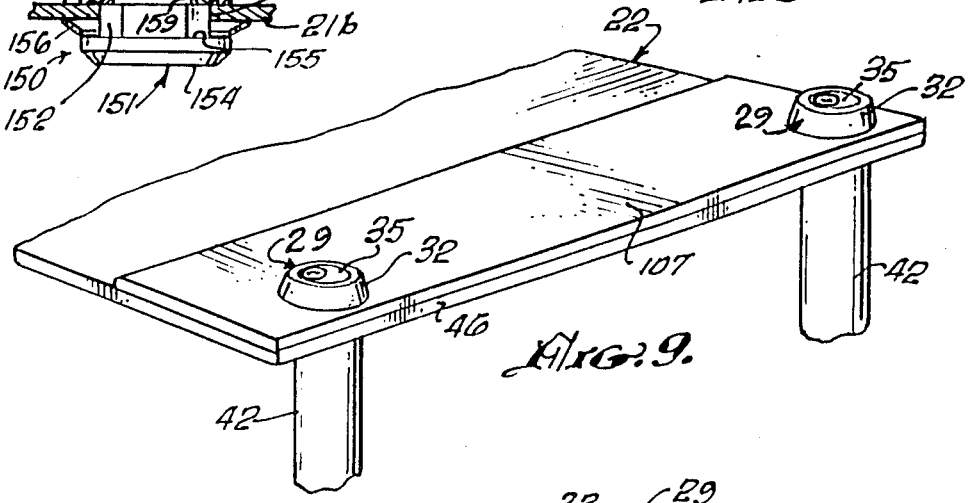
FIG. 9 is an enlarged fragmentary perspective view of a modified embodiment of the invention.

FIG. 9 illustrated another embodiment of the invention, wherein a hardened steel plate 107 adheres, such as by welding or soldering, to the top of or both sides of an upper platform 22. Plate 107 includes apertures (not shown) located therein at positions corresponding to the frontal positions for hole formations 25 in platform 22. Plate 107 engages either the top or underside of platform 22, while not interfering with the bottom of a housing 23, FIG. 2, which seats on lower platform 21. Plate 107 need not be solid across the distance shown between the sleeves 42 in FIG. 9, as long as a sufficient dimension of such a plate is disposed around each lock mechanism 29.

Figure 11:
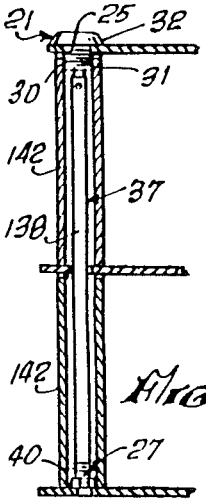
FIG. 11 is a view taken on line 11—11 of FIG. 10.
Figure 10:
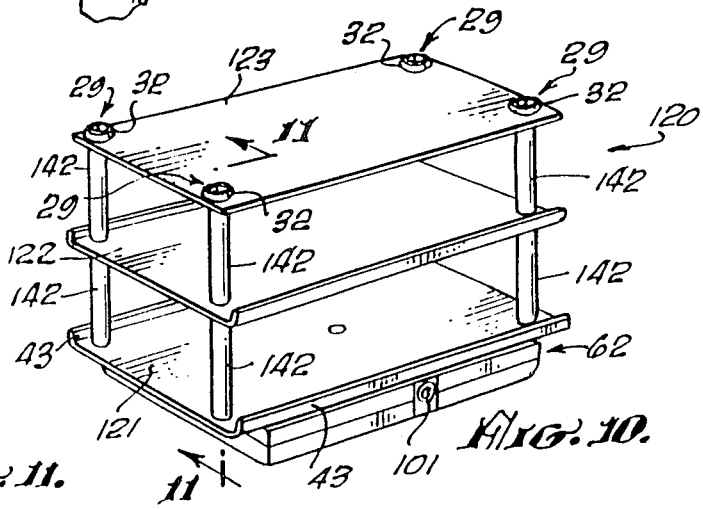
FIG. 10 is a perspective view of another embodiment of the invention.

FIGS. 10, 11 illustrate another embodiment of the invention. A plurality of platforms 121, 122, 123 are spacedly mounted one to the next in a vertical orientation to provide a multiple tiered cage assembly 120. Each one of platforms 121, 122, 123, etc., which constitutes a platform on which a housing 23, 24 is to be set, includes lips 43 and recess 44 on its front and rear edges in the same manner as these features are shown in FIG. 1, while the last or top platform, here 123, need not incorporate such features. An elongated connecting rod 138, FIG. 11, replaces each rod 38 while a plurality of case-hardened sleeves 142 are utilized in the same manner as with sleeves 42 in the FIG. 1 embodiment, with each one being disposed between a pair of next adjacent platforms, as shown in FIGS. 10, 11, and about a corresponding portion of the connecting rod 138 within such pair of platforms.

Figure 12:
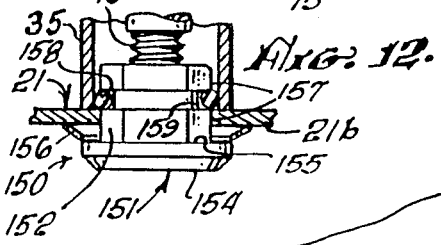
FIG. 12 is an elevational view, fragmentary and partly-in-section, of another embodiment of the invention.
Figure 13:
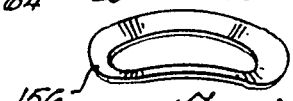
FIG. 13 is a perspective view of an element shown in the FIG. 12 embodiment.

FIGS. 12, 13 illustrate another embodiment of the invention, including a "floating nut" assembly 150 operatively connected to a cage assembly 20, 120. Assembly 150 comprises a nut 151 with its body 152 including a threaded bore (not shown) threading stem 40 of each rod 38, 138, a head 154 on nut 151 having a shoulder 155 of a dimension greater than a hole formation 25 formed in the lowest-most platform 21, and an annular curved spring washer 156 which mounts on shoulder 155 to set in assembly between it and the bottom surface **21*b* of platform 21. Curved washer 156, FIG. 13, is made and sold by Associated Spring, 18 Maim St. Bristol, Conn. 06010, catalog item #U 750-0160. At least one flat 157 [a second opposing flat 157 may be used ] is provided along the nut's body to engage one or two corresponding flats 26 provided in each hole formation 25, FIG. 7, in platform 21. Stem 40 is threaded in the same manner to nut 151 as to fastener 27. An O-ring 158 is mounted about body 152, being disposed in a circumferential recess 159 in the non-flat portion(s) of body 152, the O-ring 158 being spaced from head 154 so that body 152 is retained in its hole 25 for an assembly, i.e., so that as shown in FIG. 12, the threaded bore in body 152 is in an assembling position to receive threaded stem 40. Also, in such assembling position, O-ring 158 provides a grip to a sleeve 35 set in place over body 152, without the need for a special tool to hold sleeve 35 in position for subsequent assembling steps, and which provides needless stop in assembly. It should be noted that each sleeve 35 nevertheless remains freely rotatable after assembly, upon tangential force applied to its wall, which is the same form of force which would be applied in the earlier described embodiments in efforts to try to destroy cage assembly 20, 120 in order to get to housing 23, 24**.

In operation, after assembly of cage assembly 20, 120, about an article 23 or about article therein and article 24 secured atop platform 22, and with or without keyboard retainer 90 and/or lazy-Susan assembly 56 being included, assembly 20 prevents removal and destruction or damage of elements 23, 24. Case hardened sleeves 35 freely rotate upon application of a saw blade as the latter cannot get a bite, thus, protecting connection rod 38. Case-hardened collars 32 prevent tool cutting into metal of top platforms in the vicinity of lock mechanisms 29, without damaging cage or housings. Fastening means 27 are hidden from attack by a tool. Floating nut assembly 150, of high strength steel, repels attack by tools on it. Where the annular lip on disc 58 of the lazy-Susan is torn apart, means 70 provides the fail-safe feature by which the protected interior zone of case assembly 20, 120 remains intact. Flange 83 on guard 45 is of a length which prevents it from being slid on its lip 43, of it could be done, past a connecting rod 38, 138 or sleeve 42, 142. With platform 21, 121 secured with lazy-Susan assembly 56 to security accessory device 62 which in turn is secured to a mounting surface 66 or directly secured to mounting surface 66, neither cage assembly 20, 120 or housings 23, 24, or keyboard retainer 90 can be removed without damage or destruction. Cable guard 45 prevents access to a housing 23 in the vicinity of its connection to cable 81, without damaging such cable and housing and its contents.

An upper platform 22, 122, 123 may include a large generally centrally disposed hole (not shown), if desired or necessary, to provide clearance for connections between, say, a monitor contained in housing 24 and a central processing unit of a computer contained in housing 23.

In assembly, upper disc 58 and lower disc 60 of the lazy-Susan assembly 56 are correspondingly fastened by sets of rivets 59, 63 to lower platform 21, 121 and top plate 65 of security accessory device 62, respectively, all in known conventional manner with rivet guns. Usually lower disc 60 and top plate 65 first are fastened together, where device 62 is being utilized, and then platform 21 is fastened to upper disc 58. Fastener 75 and washer 76 are inserted from under top plate 65 through hole formation 55 of platform 21, to be fastened to pin 71. The lazy-Susan assembly or platform 21 could be fastened directly to a support surface 66, by means of the capped pin 70. Then, each connecting rod 37 is threaded to and pinned, as by 39, to shaft 33 of lock fastener means 27. Platform 22 is set upon the four sleeves 42, with hole formations 25 in platform 22 aligned with sleeves 42. A collar is set about each such hole formation 25 in platform 22, and thereafter, each connecting rod 37 is inserted therethrough and into its corresponding sleeve 42. Each stem 40 is threaded to a fastener 27, simply by inserting a key into lock cylinder 35 and rotating it, which in turn rotates rod 38 and its stem 40. Body 31, having a flat side engaging a flat 26 in each hole formation 25 of platform 22, does not rotate. As soon as platform 22 is drawn more than snug against platform 21 and each sleeve 42, the key can counter-rotate each connecting rod 38 until such sleeve is freely rotatable between platforms 21, 22.

Should it be desired to secure an article 24 to platform 22, prior to insertion of connecting rods 38, 138 into platforms 21, 22, hole formations 103 in platform 22 are utilized, with suitable fastening means such as screws (not shown). The screws are inserted from the underside of platform 22 through hole formations 103 into corresponding threaded apertures appropriately located in the underside of article 24. Thereafter platform 22 is assembled to platform 21 in accordance with steps described above.

Rubber buttons 167 may be adhesively applied, as illustrated in FIGS. 1, 4, at different locations on platforms 21, 22 to cushion or make snug an article 23 between such platforms.

Should it be desired to use a keyboard retainer 90, its feet 91 are inserted under platform 21, FIG. 4, in order that fasteners 98 secure them to such platform by threading to clinching nuts 99 attached to the underside of the feet.

When floating nut assemblies 150 are utilized, a spring washer 156 is mounted about body 152 which then is inserted from the underside of a platform 21 through a hole formation 25 in such platform. O-ring 158 is mounted to its circumferential recess in body 152 thereby retaining the nut in a "floating" condition during assembly and which provides for ease of such assembly. A sleeve 42 then is set in place and the O-ring also then functions to hold sleeve 42 in place during the remaining assembling procedure previously described. It should be noted that each curved spring washer 156 pulls its associated connecting rod 38 towards itself, the desired effect of which being to keep the pins of its corresponding lock cylinder 35 in their proper positions to insert and remove a key into such lock cylinder with ease.

Cage assembly 120 is assembled generally in the same manner as described aforesaid in regard to cage assembly 20, the one salient difference being that a number of upper platforms 122, 123 etc., are mounted upon corresponding sets of sleeves 142 which are interposed between each tier of platforms, the hole formations 25 of the platforms being correspondingly aligned with one another and in alignment with corresponding sleeves 42, all in order to be able to assemble corresponding connecting rods 138 to the cage assembly 120 as shown in FIG. 11.

Prior to assembling securing means 37 and platform 22 together with platform 21, the latter is secured to mounting member 65 of security 62 by means of securing means 70.

In further assembly, a housing 23, for example, a computer console, is set upon platform 21, with its electrical cable 81 extending outwardly beyond recess 44 in lip 43 at the rear of platform 21. The slot 82 of cable retaining guard 45 is slipped over cable 81, while the wall or rear portion 89 of housing 23 is lifted in order to insert guard flange 83 in and under housing 23 to seat upon the supporting surface of platform 21. Sleeves 42 are installed over hole formations 25 in platform 21 before or after upper platform 22 is located over housing 23, and the assembling of cage assembly 20 is carried out as described above.

In such assembling, the lateral side wall 165 (only one of which is shown in FIG. 2) of computer housing 23 are embraced by both pairs of rotatable sleeve members 42 such that it cannot be moved laterally out of cage 20. In other words, side walls 165 of article 23 are dimensionally greater than the spacing between each pair of sleeves 42 along a corresponding edge 50 of the platforms. The lips 43 on front and rear edges of lower platform 21 prevent removal of housing 23 in a forward or rearward manner from cage 20, the height of article 23 being greater than the distance between lip edge 43 and the underside of upper platform 22. Guard 45 protects the connection of cable 81 to the article at its rear wall 89. Thus, housing 23 is situated in a zone of protection while captured by cage 20. To remove computer housing 23, a key is inserted in each lock mechanism 29 which then is counter-rotated to release its corresponding rod 38 from its corresponding fastener 27, 150, thereby enabling removal of upper platform 22 and subsequent removal of the captured article from its zone of protection.

The aforescribed elements are fabricated by known processes and techniques. Annular collars 32, sleeves 42 are case-hardened, while spring washer 156 is hardened stainless steel, all of which materials prevent cutting through such elements without damaging articles 23, 24, the very things being sought. Suitable metal, plastic or rubber are utilized for the remaining elements.

Various modifications and changes may be made without varying from the scope or spirit of the invention as set out in the following claims.

We claim:

1. A cage to capture at least one article or the like comprising at least one pair of spaced platforms each of said platforms having at least two pairs or corners, each of said corners being formed by a side edge and a transversely-extending edge joining one another, lip upturned means formed on each transversely-extending edge in at least a lower one of said platforms, hole formations in each of said corners, the hole formations in corresponding corners of said spaced platforms being aligned with one another, freely rotatable sleeves mounted between said spaced platforms each of said sleeves being aligned with corresponding hole formations in corresponding corners of said spaced platforms, and means mounted on said platforms and within each of said freely rotatable sleeves for securing together said platforms.

2. The cage of claim 1 wherein said securing means comprises a connecting rod within each of said sleeves, a locking mechanism mounted on the uppermost one of said platforms and having a flat side, each hole formation in the uppermost one of said platforms including a corresponding flat side engaging the flat side of said locking mechanism, said locking mechanism being operatively connected to said connecting rod, and fastening means attached to a lowermost one of said platforms and being operatively connected to said connecting rod.

3. The cage of claim 2 wherein said fastening means comprises a threaded nut securely mounted to and atop of such lowermost one of said platforms, said connecting rod including a threaded stem for threaded attachment to said nut.

4. The cage of claim 2 wherein said fastening means comprises a nut having a body with a flat side and a threaded bore, said connecting rod including a threaded stem for threaded attachment to said bore, each hole formation in the lowermost one of said platforms including a corresponding flat side engaging the flat side of said nut, a shoulder on the nut disposed under the lowermost one of said platforms and of a dimension greater than the dimension of each of said hole formations in the lowermost one of said platforms, and a curved spring washer seated between said shoulder and lowermost one of said platforms about each of said hole formations in such lowermost one of said platforms.

5. The cage of claim 4 including an O-ring mounted in a circumferential recess provided in said body, the mounting of said O-ring in said recess being disposed within the confine of a corresponding sleeve aligned with and above said each of said hole formations in the lowermost one of said platforms.

6. The cage of claim 1 or claim 2 or claim 3 or claim 4 or claim 5 including a keyboard retainer comprising a ledge, a pair of spaced feet mounted on said ledge, said feet securely mounted under, to and along one transversely extending edge of the lowermost one of said platforms.

7. The cage of claim 1 or claim 2 or claim 3 or claim 4 or claim 5 including a lazy-Susan assembly securely mounted to the underside of the lowermost one of said platforms.

8. The cage of claim 1 or claim 2 or claim 3 or claim 4 or claim 5 including means formed in the uppermost one of said platforms of said cage for fastening from thereunder a second article to such uppermost one of said platforms.

9. The cage of claim 8 including a case-hardened sleeve mounted about said means for fastening a second article and mounted atop of such uppermost one of said platforms.

10. The cage of claim 1 or claim 2 or claim 3 or claim 4 or claim 5 including a cable guard, one of said unturned lip means including a recess for receiving said cable guard, said cable guard including a first flange for seating in said recess, a second flange mounted on said first flange for protecting the connection of the cable to its article above said one of said upturned lip means, a third flange mounted on said first flange for seating under such article mountable on a corresponding one of said platforms, and a slot for egress and ingress of the cable extending between said second flange, first flange, and third flange, the slot having an open terminus in said third flange.

11. A plurality of cages for capturing a plurality of articles or the like comprising a plurality of spaced platforms between each pair of which an article is capturable, said platforms in alignment with one another each of said platforms having at least two pairs of corners, each of said corners being formed by a side edge and a transversely-extending edge joining one another, lip upturned means on each of said transversely-extending edge in at least all but one of said plurality of spaced platforms, a hole formation in each of said corners, the hole formation in each of said corners being aligned with a hole formation in a corresponding corner in the other or others of said platforms, freely rotatable sleeves mounted between each pair of said spaced platforms each of said sleeves being in alignment with a corresponding hole formation in a corresponding corner of each of said spaced platforms, and means mounted on uppermost and lowermost ones of said platforms and within each of said freely rotatable sleeves for securing together with platforms.

12. The plurality of cages of claim 11 wherein said securing means comprises a connecting rod, a locking mechanism mounted on the uppermost of said platforms and having a flat side, each hole formation in the uppermost one of said platforms including a corresponding flat side for engaging the flat side of such a locking mechanism, said locking mechanism being operatively connected to said connecting rod, and fastening means attached to the lowermost one of said platforms and being operatively connected to said connecting rod, each said connecting rod extending through aligned hole formations in said spaced platforms and within the confine of each of said sleeves mounted between each pair of said platforms and aligned with such aligned hole formations.

13. The plurality of cages of claim 12 wherein said fastening means comprises a nut on which a flat side is mounted and having a body and a threaded bore, said connecting rod including a threaded stem for threaded attachment to said bore, a shoulder on the nut disposed under the lowermost one of said platforms and of a dimension greater than the dimension of each of said hole formations in such lowermost one, and a curved spring washer seated between said shoulder and lowermost one of said platforms about each of said hole formations in such lowermost one, the lowermost one of said platforms including a flat side in a corresponding hole formation for engagement with the flat side in said nut.

14. The plurality of cages of claim 13 including an O-ring mounted in a recess provided in said body, the recess for the O-ring being disposed within the confine of a corresponding sleeve aligned with and above a corresponding hole formation in the lowermost one of said platforms.

15. The plurality of cages of claim 13 or claim 14 including a key board retainer comprising a ledge, a pair of spaced feet mounted on said ledge, said feet securely mounted under, to and along one transversely-extending edge of the lowermost one of said platforms.

16. The plurality of cages of claim 15 including a lazy-Susan assembly securely mounted to the underside of the lowermost one of said platforms.

17. The plurality of cages of claim 13 or claim 14 including a lazy-Susan assembly securely mounted to the underside of the lowermost one of said platforms.

18. An improvement in a cage assembly securing together a pair of spaced platforms, each of said spaced platforms including hole formations aligned with corresponding hole formation in the other of said platforms, said improvement comprising at least one flat side in each of said hole formations, a rod, a lock mechanism mounted to each of such hole formations in the upper of said platforms and having a flat side, a fastening means mounted to each of such hole formations in the lower of said platforms and including a body having a flat side, the flat sides on said lock mechanism and body engaging corresponding flat sides in corresponding aligned hole formations in the upper and lower platforms, said lock mechanism and fastening means operatively connected to said rod, a shoulder on said body disposed under the lower of said platforms and of dimension greater than the dimension of its body's corresponding one of said hole formation in such lower platform, and a curved spring washer seated between said shoulder and lower platform about such corresponding one of said hole formations in such lower platform.

19. The plurality of cages of claim 11 or claim 12 or claim 13 or claim 14 including means formed in the uppermost one of said platforms of said cage for fastening from thereunder a second article to such uppermost one of said platforms.

20. The plurality of cages of claim 19 including a case-hardened sleeve mounted about said means for fastening a second article and mounted atop of such uppermost one of said platforms.

21. The plurality of cages of claim 11 or claim 12 or claim 13 or claim 14 including a cable guard, one of said lip means including a recess for receiving said cable guard, said cable guard including a slot for ingress of a cable of an article captured by said cage, a first flange for seating in said recess, a second flange protecting the connection of the cable to its article above said one of said lips, and a third flange for seating under such article mountable on a corresponding one of said platforms.

22. An improvement in a cage assembly securing together a plurality of spaced platforms, each of said spaced platforms including hole formations aligned with corresponding hole formations in the other of said platforms, said improvement comprising at least one flat side in each of said hole formations in the uppermost and lowermost of said platforms, a rod, a lock mechanism mounted to each of such hole formations in the uppermost of said platforms and having a flat side, a fastening means mounted to each of such hole formations in the lowermost of said platforms and including a body having a flat side, the flat sides on said lock mechanism and body engaging corresponding flat sides in corresponding aligned hole formations in the uppermost and lowermost platforms, said lock mechanism and fastening means operatively connected to said rod, a shoulder on said body disposed under the lowermost of said platforms and of dimension greater than the dimension of its body's corresponding one of said hole formations in such lowermost platform, and a curved spring washer seated between said shoulder and lowermost platform about such corresponding one of said hole formation in such lowermost platform.

23. The cage of claim 4 or claim 5 or claim 13 or claim 14 or claim 18 or claim 22 including a case-hardened collar mounted about each hole formation in and on the uppermost one of said platforms, said locking mechanism seated in said collar.

24. The cage of claim 23 wherein said collar abuts a corresponding side edge of the uppermost one of side platforms.

* * * * *